United States Patent [19]

Kornick

[11] 3,994,553

[45] Nov. 30, 1976

[54] DISCHARGE RESISTANT CABLE CONNECTOR

[75] Inventor: Abraham Kornick, Los Angeles, Calif.

[73] Assignee: Reynolds Industries, Inc., Los Angeles, Calif.

[22] Filed: Apr. 18, 1975

[21] Appl. No.: 569,440

Related U.S. Application Data

[63] Continuation of Ser. No. 431,689, Jan. 9, 1974, abandoned, which is a continuation of Ser. No. 170,818, Aug. 11, 1971, abandoned.

[52] U.S. Cl. ..... 339/60 R; 339/211; 339/221 R

[51] Int. Cl.² ..... H01R 13/52

[58] Field of Search ..... 339/59–61, 339/94, 177, 211, 221

[56] References Cited

UNITED STATES PATENTS

| | | | |
|---|---|---|---|
| 2,379,942 | 7/1945 | Webber | 339/60 C |
| 2,906,986 | 9/1959 | Schaefer | 339/60 R |
| 2,935,720 | 5/1960 | Lorimer | 339/94 C |
| 2,945,203 | 7/1960 | Quackenbush | 339/59 R |
| 3,124,405 | 3/1964 | Massa | 339/60 R |
| 3,199,060 | 8/1965 | Marasco | 339/60 R |
| 3,344,391 | 9/1967 | Ruete | 339/60 R |

*Primary Examiner*—Roy Lake
*Assistant Examiner*—Neil Abrams
*Attorney, Agent, or Firm*—Fulwider, Patton, Rieber, Lee & Utecht

[57] ABSTRACT

A cable connector including a plug and a receptacle, the plug having a resilient inner insulator with its rear portion surrounded by a non-resilient body which restrains resilient sealing deformation of the insulator as an electrical cable and attached contact are inserted into the insulator. A plurality of sealing rings extending into the inner diameter of the insulator are resiliently deformed to form a positive seal around the cable. A raised seal on the forward portion of the insulator sealingly engages the receptacle bore as the plug is inserted therein. Additional seals are formed between a forward end of the insulator and the bottom of the bore and between a shoulder on the insulator and an outer lip of the receptacle bore as the plug and receptacle are coupled.

5 Claims, 2 Drawing Figures

DISCHARGE RESISTANT CABLE CONNECTOR

This is a continuation of application Ser. No. 431,689, filed Jan. 9, 1974, and now abandoned, which was a continuation of application Ser. No. 170,818, filed Aug. 11, 1971, and also now abandoned.

BACKGROUND OF THE INVENTION

The present invention relates generally to electrical cable connectors and, more particularly to a corona discharge resistant cable connector.

In high voltage applications, particularly in high altitude environments, it is conventional practice to use electrical cable connections which are pressure sealed to avoid certain electrical phenomenon which are altitude sensitive. One such imperfectly understood electrical phenomenon is the corona discharge in which high voltage electrical conductors discharge directly into a gaseous mixture such as ordinary air with accompanying crackling noises or an actual visual glow.

It has been found that such electrical discharges can be reduced by reducing to a minimum the exposure of high voltage conductors to air. Typically, this means that a cable connector has relatively tightly fitting plug and receptacle sections which are pressure sealed when coupled.

Due to the difficulties in reducing air spaces in the plug when it is attached to a cable, connectors have typically been designed with a resilient sealing member which must be molded directly over a contact element on the end of a cable as a part of the plug. However, this type of construction requires, as a practical matter, that the cable be purchased connected to the plug. Therefore, a replacement plug cannot be installed without also replacing the cable.

Thus, there has long been a need for a pressure sealing, corona resistant cable connector which could be installed on an electrical cable in the manner of a normal cable connector without special molding tools. The cable connector of the present invention satisfies that need.

SUMMARY OF THE INVENTION

The present invention provides a cable connector which may be purchased separately from the electrical cable to be used and which may be installed on the cable without special procedures or tools. When the assembled cable and plug are coupled to the receptacle section of the complete connector, the electrical contacts in the connector are substantially completely sealed from the outside atmosphere. Further, such complete sealing is formed in a manner which minimizes any remaining air in the interior portions of the connector to substantially reduce any corona discharge within the connector.

During the attachment of the plug section of the connector to the cable, a general interference fit seal is formed together with a number of positive discrete seals in order to insure proper sealing of the plug to the cable.

To effect this sealing, the plug of the connector utilizes a resilient inner insulator into which an electrical cable and attached contact element are pushed with an interference fit. A non-resilient body surrounds the section of the insulator surrounding the cable to aid in the formation of the seal by resisting deformation of the insulator. Additionally, at least one sealing ring is provided around the inside of the insulator which engages the insulation of the electrical cable to provide a positive sealing point to insure proper sealing of the insulator with the cable. Thus, during attachment of the plug to the cable, the contact element and cable are completely surrounded by the inner insulator with substantially no air spaces remaining between the electrical conducting elements and the insulator.

Upon coupling of the plug with the receptacle, the forward portion of the inner insulator surrounding the contact substantially completely fills the receptacle bore. To provide a positive sealing point, a raised seal is provided around the outside of the plug insulator which contacts the wall of the receptacle bore as the plug is inserted into the receptacle. The axial male contact in the receptacle enters a small hole in the forward end of the plug to make contact with the contained female contact. As the plug and receptacle are drawn tightly together by a coupling nut, the forward end of the inner insulator contacts the bottom of the receptacle bore immediately adjacent the contacts, and is deformed into a substantial sealing engagement. The surface of the insulator may also be deformed into sealing engagement with the inner wall of the receptacle bore to further reduce any remaining air space or air gap in the coupled connector. In addition, a sealing shoulder on the inner insulator contacts the outer lip of the receptacle bore to form an additional positive sealing point.

Thus, in the cable connector of the present invention, a number of positive sealing points are created together with additional interference fit sealing engagements between the plug and receptacle as the cable and contact are attached to the plug and when the plug is in turn coupled to the receptacle. Further, the cable connector of the present invention may be purchased separately and thereafter installed on a cable to provide a sealed connection with substantially no air gaps or air spaces surrounding the electrical conductors within the connector to substantially reduce the possibility of corona discharge.

DESCRIPTION OF THE PREFERRED EMBODIMENT

Figure 2:
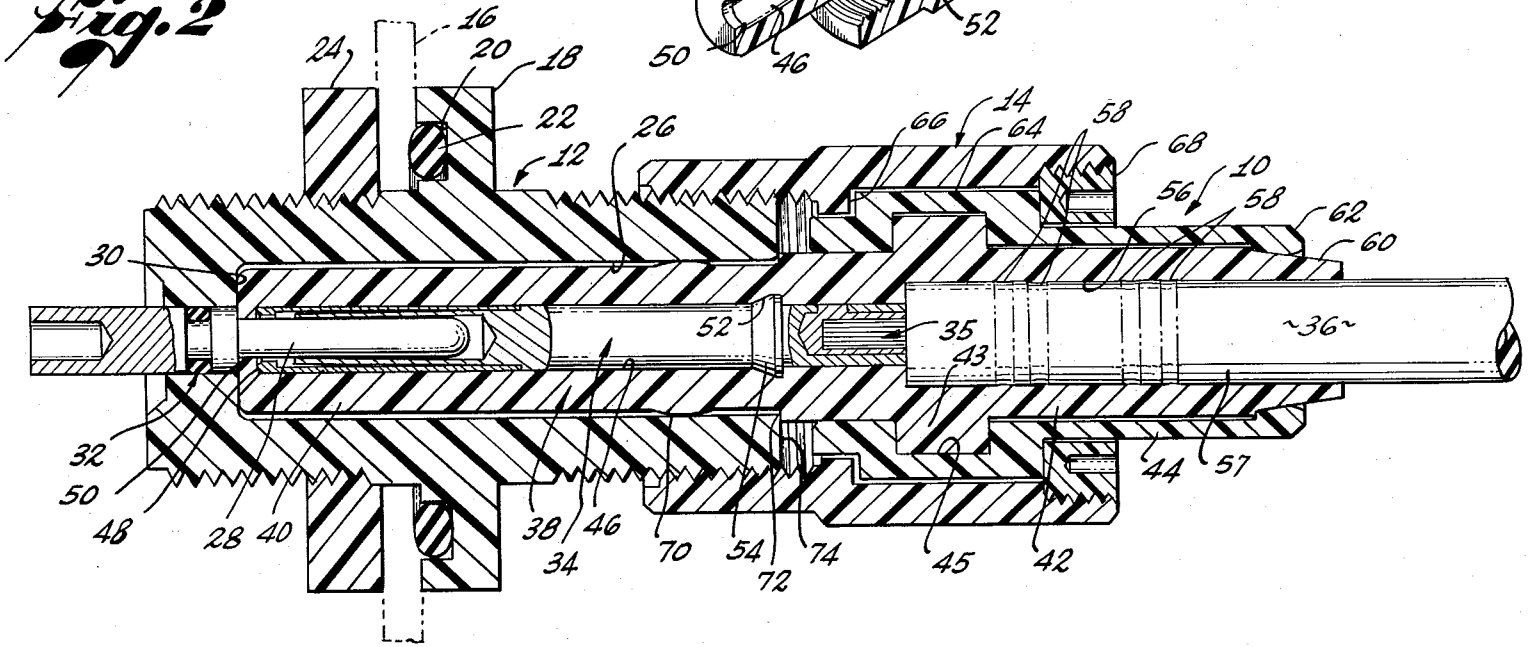
FIG. 2 is a sectioned elevational view of the coupled plug and receptacle sections of the connector.

Turning now to the drawings, and particularly FIG. 2 thereof, a cable connector constructed in accordance with the present invention has a plug 10 and a receptacle 12 adapted to be coupled together by a conventional means such as a threaded coupling nut 14 rotatably mounted on the plug and which engages the exterior of the receptacle. For conventional use, the receptacle 12 is mounted on a panel 16 and is sealed to the panel by means of a flange 18 having a circular groove 20 containing an O-ring 22. A nut 24 threaded on the receptacle 12 on the outer side of the panel 16 maintains the receptable in sealed position on the panel.

In accordance with conventional construction techniques for high voltage connectors, the receptacle has an elongated bore 26 and a male contact element 28 axially extending into the bore from a closed end 30 thereof. The male contact element 28 is pressure sealed to the end 30 of the bore 26 by means of an O-ring seal 32. This conventional construction for the receptacle 12 substantially shields the male contact element 28 from accidental contact with a person or object when the plug 10 is not coupled to the receptacle.

The overall construction of the plug 10 is also conventional in that it includes an elongated female contact 34 attached by a solder connection 35 to an electrical cable 36 both of which are axially mounted within the plug. The elongated female contact 34 is completely surrounded by an elongated resilient inner insulator 38 again partially to prevent accidental touching of the female contact when not coupled to the receptacle 12. The length of the receptacle bore 26 and insulator 38 are generally established by voltage safety considerations which are of no concern here.

A cable connector constructed in accordance with the present invention has additional features which make it particularly advantageous in high voltage applications. Particularly, the plug 10 is designed to be installed on the end of a cable 36 as an original or a replacement part without the use of any special tools or molding equipment. The process of installing the plug 10 on the end of the cable 36 is accomplished with the elimination of substantially all of the air spaces around the female contact 34 and the cable 36 to substantially reduce any corona discharge. This is accomplished by providing a general interference fit between the female contact 34, and cable 36, and the resilient insulator 38 as the contact and cable are inserted into the plug 10. Further, to insure proper sealing, additional discrete positive seals within the insulator 38 are also provided to engage the cable 36.

Figure 1:
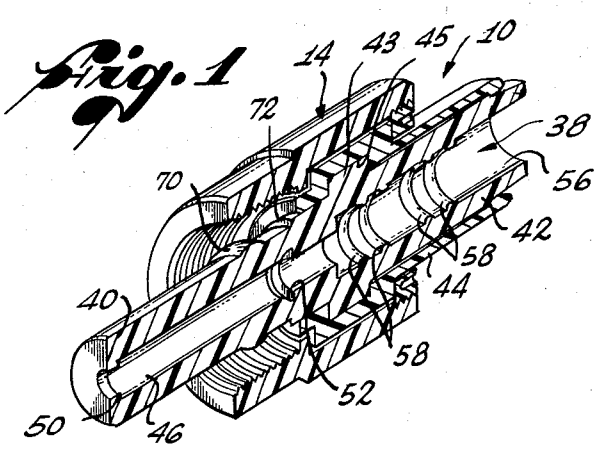
FIG. 1 is a sectioned perspective view of the plug section of the cable connector of the present invention shown without the cable and contact.

The construction of the plug 10 before its attachment to the cable 36 is best illustrated in FIG. 1. In accordance with the invention, the insulator 38 is made of a resilient insulating material and has a forward portion 40 and a rear portion 42. The rear portion is surrounded by a body 44 made of a non-resilient insulating material. It should be noted, however, that there may be occasion to couple a shielded cable to a receptacle in which case the body 44 could be constructed of a conducting material with some provision for attachment of a shielded braid of the cable.

The outside diameter of a rear portion 42 of the insulator 38 is provided with a locking collar 43 which extends into a corresponding groove 45 on the inside of the body 44 to fix the body in position on the insulator 38. The diameter of a contact bore 46 through the forward portion 40 is, preferably, slightly smaller than the diameter of the female contact 34 (FIG. 2) to provide an interference fit as the contact is inserted into the insulator 38. The contact bore 46 is of sufficient length so that, when the contact 34 is completely inserted into the insulator 38, a free end 48 (FIG. 2) of the contact resiliently abuts against a radially inwardly extending flange 50 on the forward end of the insulator 38. The contact 34 is therefore completely externally surrounded by resilient insulating material to eliminate air spaces.

To substantially lock the contact 34 and the cable 36 within the plug 10, the contact bore 46 in the insulator 38 includes a sloped locking groove 52 and, as can be seen in FIG. 2, the contact has a corresponding sloped locking shoulder 54 which engages the groove.

As is best seen in FIG. 1, the insulator 38 also has a cable bore 56 through the rear portion 42. Again, the diameter of the cable bore 56 is, preferably, slightly smaller than the outside diameter of the insulator 56 of the cable 36. However, as the outside diameter of the cable 36 varies within a range of diameters, the inside of the cable bore 56 includes additional discrete sealing rings 58. In the illustrated presently preferred embodiment, there are four sealing rings 58 which have a hemispherical cross section and are arranged in pairs but, it should be appreciated that a number of other configurations are possible. Thus, it can be seen that the cable 36 is positively sealed to the insulator 38 at discrete points along the cable to insure effective sealing without the necessity of integrally molding the cable to the insulator. It will be appreciated that the sealing action of the cable bore 56 and sealing rings 58 is enhanced by the fact that the body 44 of the plug 10 resists resilient deformation of the contained insulator 38 as the cable 36 is inserted into the plug.

To provide additional sealing action as the cable 36 is inserted into the plug 10, the insulator 38 may be provided with a tapered rear end 60, as best seen in FIG. 2, and the rear end of the body 44 is provided with a radially inwardly extending bulbous edge 62 which may radially inwardly distort the tapered rear end 60 of the insulator 38 even before the cable 36 is inserted. Thus, as the cable 36 is inserted into the plug 10, the tapered rear end 60 of the insulator is resiliently deformed into a positive sealing engagement with the cable 36.

The plug 10 assembly is completed by adding the coupling nut 14 which is rotatably mounted around a raised outer collar 64 of the body. The coupling nut 14 is held in place around the collar 64 by a forward shoulder 66 integrally formed on the nut and a retaining ring 68 threadedly inserted into the rear of the coupling nut 14.

Thus, it can be seen that the plug 10 and female contact 34 may be purchased as separate items and after the contact is attached to the conductor of the cable 36 the assembly may be sealed within the plug 10 by merely inserting the contact and cable into the rear of the plug and pushing until the contact and cable are in position. Thus, the contact 34 and cable 36 are sealed within the plug 10 simultaneously with the attachment of the plug 10 to the cable.

To insure proper sealing of the plug 10 within the receptacle 12, a number of discrete positive sealing points are provided which may be sequentially formed as the plug is inserted into the receptacle. Particularly, the outer diameter of the forward portion 40 of the insulator 38 is provided with a raised seal 70, which can best be seen in FIG. 1. The cross section of the raised seal 70 preferably has rounded edges and a relatively wide outer surface for contacting the surface of the receptacle bore 26. Additionally, the insulator is provided with a raised sealing shoulder 72 which engages an outer lip 74 of the receptacle bore 26.

As the plug 10 is inserted into the receptacle 12, the raised seal 70 sealingly engages the surface of the receptacle bore 26. As the plug is further inserted into the receptacle bore 26 aided by the threaded engagement of the coupling nut 14 with the exterior of the receptacle 12, the flange 50 on the forward end of the insulator 36 contacts, or "bottoms," on the enclosed bottom 30 of the receptacle bore 26. The flange 50 on the forward end of the insulator 38 is then resiliently deformed into sealing engagement with the bottom 30 of the bore, the sealing engagement being aided by the rigid free end 48 of the female contact 34. The sealing shoulder 72 preferably then engages the outer lip 74 of the receptacle bore 26 to form another positive sealing point.

Thus, when the plug 10 is coupled to the receptacle 12, there are at least three positive sealing points between the electrical contacts 28, 34 and the outer air. Depending on the applied coupling force and the tolerance of the connector elements, the outer surface of the forward section 40 of the insulator 38 may also be resiliently deformed into contact with the surface of the receptacle bore 26.

It can be seen that the seal formed by the flange 50 on the forward end of the insulator 38 is immediately adjacent the electrical contacts 28, 34 to substantially eliminate any air space around the contacts and reduce any corona discharge. Should this seal at the flange 50 fail, it can be seen that the raised seal 70 and the shoulder seal 72 still provide positive sealing. Additionally, the resilient deformation of the insulator 38 as the coupling nut 14 is tightened substantially removes any air spaces between the plug 10 and receptacle 12 of the connector to further reduce the possibility of corona discharge.

Thus, a cable connector constructed in accordance with the present invention may be quickly and easily attached to a cable without special tools or equipment and that attachment of the plug 10 to the cable 36 also positively seals the plug to the cable. When the plug 10 is coupled to the receptacle 12, a plurality of positive discrete seals are formed and further resilient deformation of the insulator of the plug substantially eliminates air spaces adjacent to the electrical contacts in the connector to substantially reduce the possibility of corona discharge.

While a particular preferred embodiment of the cable connector of the present invention has been described in detail, it should be appreciated that numerous variations in the basic configuration of the connector are possible. Therefore, the scope of the invention is not to be limited except by the following claims.

I claim:

1. In a pressure sealing, corona discharge resistant cable connector for installation on insulated electrical cables, the connector having a plug section and a receptacle section and means for coupling said sections together, said receptacle section including an axial bore containing a first elongated contact assembly secured in the base of said axial bore, the improvement comprising:

a non-resilient outer body for said plug section, said outer body having an axial bore;

a resilient insulator having a rear portion secured in said axial bore of said plug section and an elongated forward portion extending out of said plug section and receivable in said axial bore of said receptacle section;

an axial contact bore formed in the forward portion of said insulator and adapted to receive a second elongated contact assembly of greater diameter than said contact bore to provide an interference fit between the second contact assembly and said contact bore;

flange means formed on the end of said forward portion of said insulator to partially cover the end of said contact bore and to engage the base of said receptacle section axial bore around the circumference of the first contact assembly when said sections are coupled together;

an annular locking groove formed in the surface of said contact bore for receiving a locking collar formed on the second contact assembly;

a raised annular seal integrally formed on the outer surface of said forward portion of said insulator for engaging the inner surface of said receptacle axial bore when said sections are coupled together;

an annular sealing shoulder formed on the outer surface of said insulator, rearwardly of said raised annular seal, and adapted to engage the end of said receptacle section, to provide an additional seal at the opening of said receptacle axial bore when said sections are coupled together;

an axial cable bore formed in the rear portion of said insulator and adapted to receive an insulated electrical cable of greater diameter than said cable bore to provide an interference fit between the cable and the cable bore, the cable including conductor means electrically connected to the second contact assembly; and at least one sealing ring integral with the inside surface of said cable bore and extending radially inwardly thereof for engaging the cable, said sealing ring being deformed radially outwardly by the insertion of a cable into said cable bore, the interference fit of said insulator and said flange means, raised annular seal, annular sealing shoulder and sealing ring cooperating to isolate the electrical contact assemblies from the atmosphere when the sections of said connector are coupled together.

2. A cable connector according to claim 1, further including an annular locking collar formed on said rear portion of said insulator and a corresponding locking groove formed in said outer body, said locking collar engaging said locking groove to secure said insulator in said outer body.

3. A cable connector comprising:

a receptacle section having a housing with an axial bore and a base portion at the end of said bore;

a first elongated electrical contact assembly mounted in said base portion of said receptacle housing and extending axially in said bore;

a plug section adapted to be coupled to said receptacle section, said plug section having a non-resilient outer body with an axial bore;

a resilient insulator having a rear portion secured in said axial bore of said plug section and an elongated forward portion extending out of said plug section and receivable in said axial bore of said receptacle section, the rear portion of said insulator having an axial cable bore and the forward portion of said insulator having an axial conduct bore;

a second elongated contact assembly mounted in said contact bore, said second contact assembly being of greater diameter than said contact bore to provide an interference fit;

flange means formed on the end of said forward portion of said insulator to partially cover the end of said contact bore so that said second contact assembly is enclosed by said insulator, and to engage said base portion of said receptacle housing around the circumference of said first contact assembly when said sections are coupled together;

a locking collar formed on said second contact assembly and engaging a corresponding locking groove formed in said insulator for securing said second contact in said contact bore;

an insulated electrical cable mounted in said cable bore, said cable being of greater diameter than said cable bore to provide an interference fit, said cable included conductor means electrically connected to said second contact assembly;

first sealing means including at least one sealing ring integral with the inside surface of said cable bore and extending radially inwardly thereof for engaging said cable, said sealing ring being deformed radially outwardly by sealing engagement with the insulation of said insulated cable;

second sealing means including a raised annular seal integrally formed on the outer surface of said forward portion of said insulator for engaging the inner surface of said receptacle axial bore when said plug and receptacle sections are coupled together, said flange means and said first and second sealing means isolating said first and second electrical contacts from the atmosphere when said connector is coupled; and an annular sealing shoulder formed on the outer surface of said insulator, rearwardly of said second sealing means, and adapted to engage the end of said receptacle housing, to provide additional sealing means at the opening of said receptacle axial bore when said receptacle and plug sections are coupled together.

4. A cable connector as defined in claim 3, further including a locking collar formed on the outer surface of the rear portion of said insulator engaging a corresponding locking groove formed in said axial bore of said plug section to secure said insulator in said plug section.

5. A cable connector as defined in claim 4, wherein said rear portion of said insulator has a radially inwardly sloping rear end, and said outer body has a radially inwardly extending rear end in contact with said sloping rear end of said insulator, said rear end of said rear portion of said insulator being normally slightly radially inwardly deformed thereby.

* * * * *

UNITED STATES PATENT OFFICE

CERTIFICATE OF CORRECTION

PATENT NO. : 3,994,553

DATED : April 18, 1975

INVENTOR(S) : Abraham Kornick

It is certified that error appears in the above-identified patent and that said Letters Patent are hereby corrected as shown below:

Column 6, line 52, "conduct" should be --contact--

Signed and Sealed this

Seventh Day of June 1977

[SEAL]

*Attest:*

RUTH C. MASON
*Attesting Officer*

C. MARSHALL DANN
*Commissioner of Patents and Trademarks*